United States Patent [19]

Geisinger

[11] 4,177,546

[45] Dec. 11, 1979

[54] APPARATUS FOR INSERTING A RESILIENT BAND ON A CONTAINER

[76] Inventor: Wolfgang Geisinger, 180 rue Paradis, Rosemere, Quebec, Canada

[21] Appl. No.: 880,639

[22] Filed: Feb. 23, 1978

[30] Foreign Application Priority Data

Aug. 22, 1977 [CA] Canada ..... 285194

[51] Int. Cl.[2] ..... B23P 19/02

[52] U.S. Cl. ..... 29/235; 29/243.52; 53/585

[58] Field of Search ..... 29/235, 243.52, 282; 53/291-294, 585

[56] References Cited

U.S. PATENT DOCUMENTS

| | | | |
|---|---|---|---|
| 3,238,609 | 3/1966 | Nichols | 29/235 |
| 3,369,286 | 2/1968 | Marshall | 29/235 |

*Primary Examiner*—James G. Smith

[57] ABSTRACT

The disclosure herein describes a device for inserting a plastic bail band on a parenteral solution bottle equipped, adjacent its bottom edge, with a band-receiving recess; the device consists of a hollow cylindrically shaped member on top of which is placed the band and in the side wall of which is formed a series of radially displaceable fingers; a bottle-receiving plunger is slidingly mounted within the cylindrical member effecting, when actuated, radial displacement of the fingers; the opening of the fingers is calculated so that the fingers never touch the bottle as the band is slid along the bottle into the band-receiving recess.

9 Claims, 5 Drawing Figures

26
78
20
36
40
42
64
60
62
63
52
56
44
76
73
38
54
65
77
58
75
18
79
66
70
68
72
48
46
67

APPARATUS FOR INSERTING A RESILIENT BAND ON A CONTAINER

FIELD OF THE INVENTION

The present invention relates to a device for inserting a resilient band on a container and, more particularly, relates to a device for inserting a plastic bail band in the band-receiving recess of a parenteral solution bottle.

BACKGROUND OF THE INVENTION

Containers are known which are equipped with a plastic band having a semi-circular shaped handle to support the container; one example of such handle may be found described in applicant's copending Canadian application Serial No. 218,239 filed Jan. 20, 1975. Other handles may also be found described in U.S. Pat. No. 3,220,591 issued Nov. 30, 1975, U.S. Pat. No. 3,311,252 issued Mar. 28, 1967 and U.S. Pat. No. 3,653,610 issued Apr. 4, 1972.

Some of the containers used with these handles are pharmaceutical bottles used in the administering of intravenous solutions; these bottles are provided with an annular recess adjacent their bottom face to receive a bail which serves to support the bottle in an inverted position during the dispensing of a solution to a patient. The bail may be made of metal, or as described in applicant's copending application described above, of a plastic material such as polyethylene.

In U.S Pat. No. 3,067,501 issued Dec. 11, 1962, there is described a device for applying a plastic bail band to the recess of a parenteral solution bottle. The device includes a series of jaw elements which first expand the band before positioning it in the recess of the bottle. It is noted, however, that after stretching the band and loading the bottle, the jaw elements contact the bottle. This contact between the tool and the bottle must absolutely be avoided because the sterilization process required for the intended use of such bottle renders it brittle; for any small pressure exerted thereon, the bottle breaks easily.

OBJECTS AND STATEMENT OF THE INVENTION

It is an object of this invention to provide a device for placing a resilient band on a contaner wherein the band is expanded by the container itself.

It is a further object of this invention to provide an apparatus for inserting a plastic bail band on a parenteral solution bottle wherein the only part of the apparatus which contacts the bottle is that of a plunger which serves to support the bottle so that no moving parts on the device come in contact with the bottle.

The present invention therefore relates, in its broadest aspect, to an apparatus for inserting a resilient band on a container, comprising: an outer cylindrical member having a top wall receiving thereon the band to be inserted, the cylindrical member having a series of circumferentially spaced slits extending from its top wall to a location on its side wall and defining a series of radially actuatable fingers; plunger means slidably mounted in the cylindrical member and in contacting engagement with the fingers, the plunger means having a top wall receiving the container thereon; and actuator means forcing the plunger means inside the cylindrical member and causing radial opening of the fingers whereby the band on the top wall of the cylindrical member may be slid on the container; the radial opening of the fingers being such to avoid contact of the fingers on the container as the band slides on the container.

Since the radial opening of the fingers is caused by the contacting engagement of the plunger means on the inside wall of the fingers, in one preferred form of the invention, a replaceable wear ring is provided between the fingers and the plunger means.

Other objects and further scope of applicability of the present invention will become apparent from the detailed description given hereinafter; it should be understood, however, that the detailed description while indicating a preferred embodiment of the invention, is given by way of illustration only since various changes and modifications within the spirit and scope of the invention will become apparent to those skilled in the art from this detailed description.

DESCRIPTION OF PREFERRED EMBODIMENTS

Figure 1:
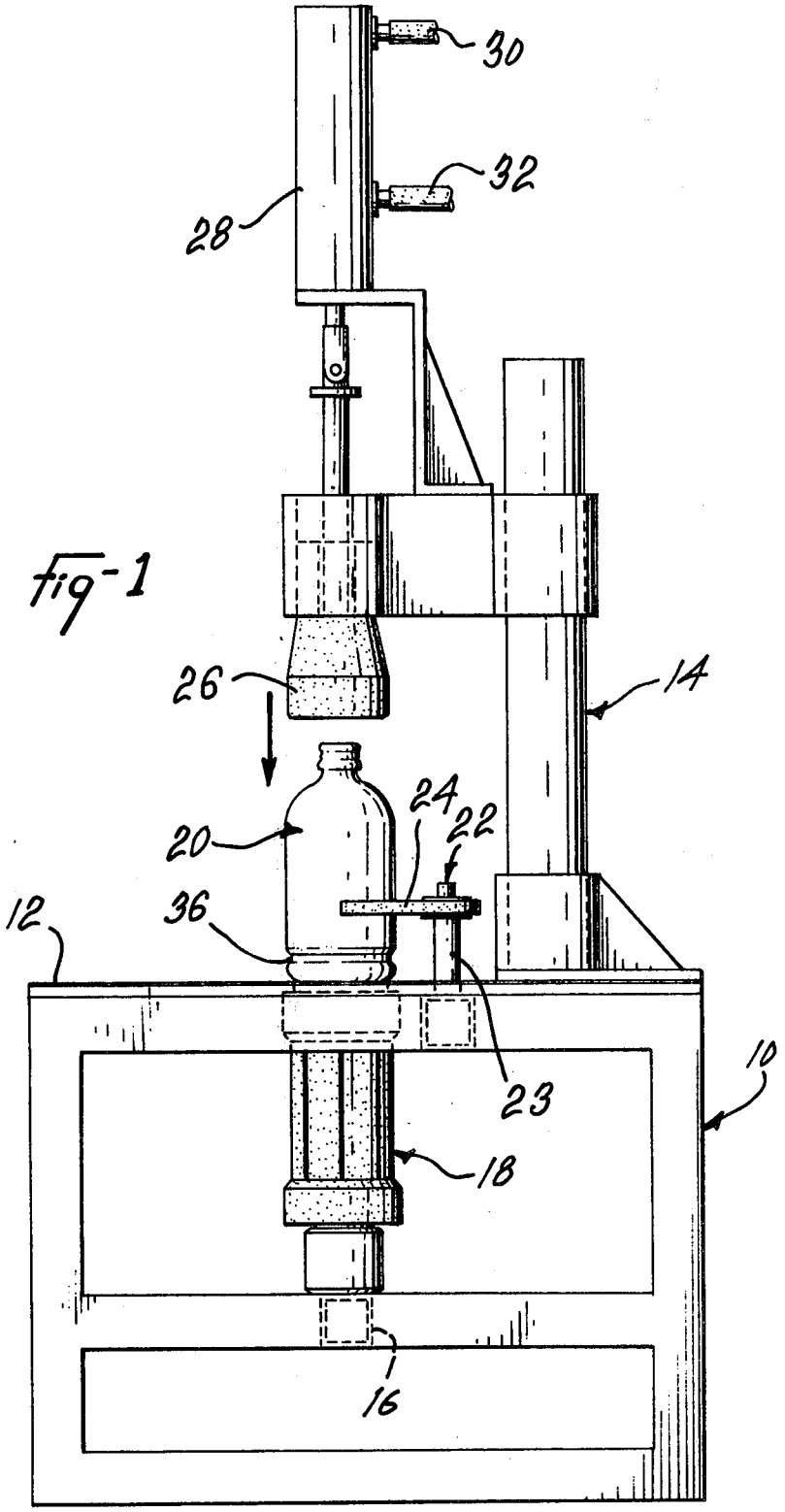
FIG. 1 is an elevational view of a work table showing an apparatus made in accordance with the present invention on which a parenteral solution bottle has been placed.

Referring to FIG. 1, there is shown a work table that includes a structural frame 10 with a top plate 12 that supports an upright structure 14. The frame 10 includes a cross-brace 16 to which is fixedly secured a device 18 made in accordance with the present invention. The upper part of device 18 terminates adjacent a circular opening (not shown) in plane of the top plate 12.

In the embodiment illustrated, a bottle 20, such as the one used for the administering of a parenteral solution, is shown resting on the upper part of device 18. A bottle locating device 22 is mounted on top plate 12 and includes a vertical support 23 and a locator plate 24 provided with a semi-circular recess that fits the contour of the bottle.

The upright structure 14 includes a bottle cap or holder 26 which has an internal configuration adapted to fit the contour of the upper part of bottle 20. Holder 26 is connected to a drive means, such as a hydraulically operated cylinder 28 which, in turn, may be connected to a drive source (not shown) by means of two conduits 30 and 32.

Figures 2, 3, 4, 5:
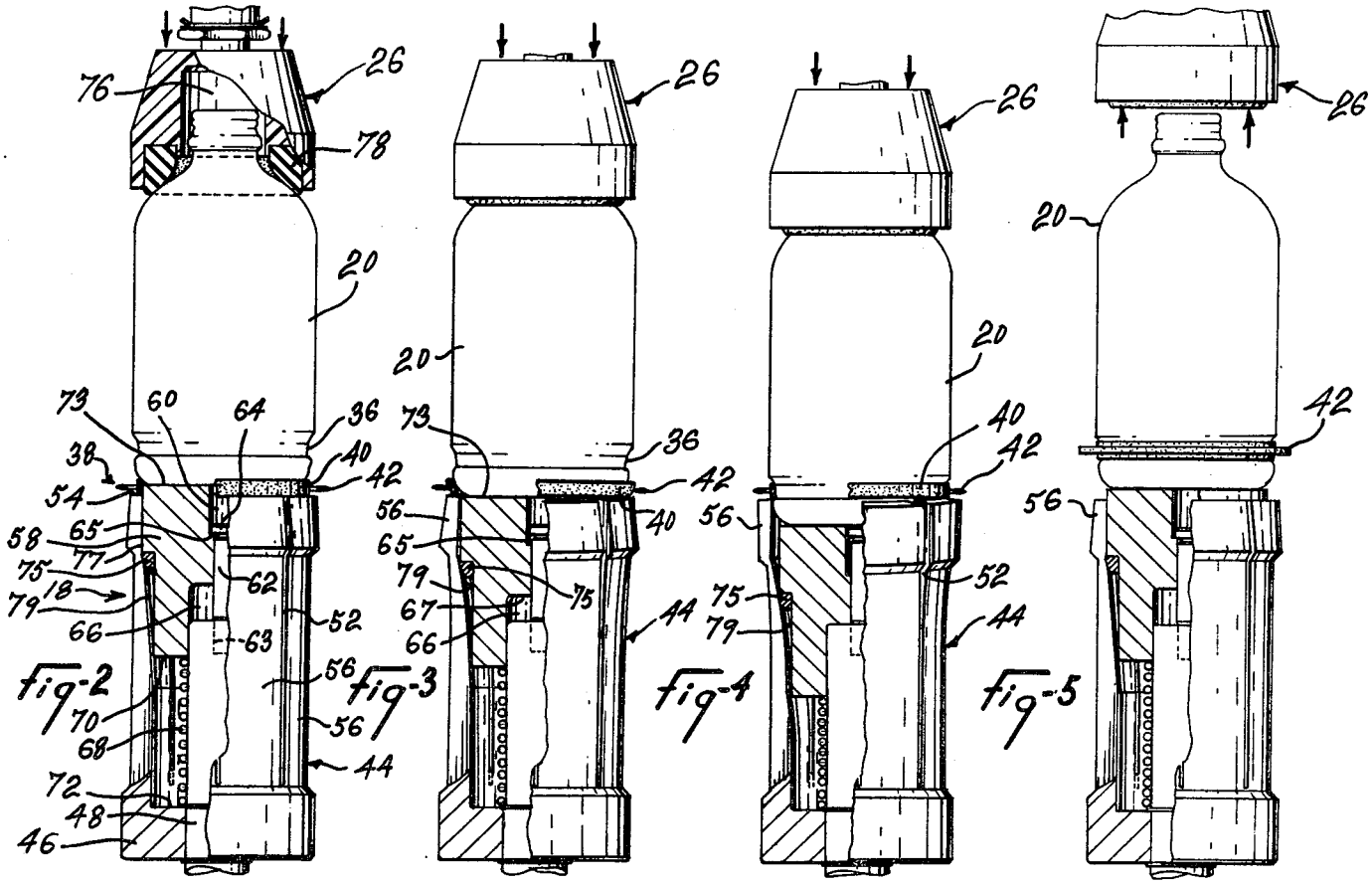
FIGS. 2–5 are elevational partly sectional views showing the successive steps performed in inserting a band on the bottle in accordance with the present invention.

Referring more particularly to FIG. 2, bottle 20 is provided, adjacent the bottom end thereof, with an annular recess 36 in which there is to be inserted a plastic handle 38, similar to the one described in applicant's copending patent application Ser. No. 218,239 filed Jan. 20, 1975. As pointed out above, such a handle may be constructed of a plastic material, such as polyethylene, and usually consists of a band portion 40 and a bail portion 42 forming a unitary structure.

Device 18 includes a cylindrical outer member 44 having a base portion 46 fixedly mounted to a vertical support 48 which is fixed to the cross-brace 16 of the work table. Member 44 includes a series of circumferentially spaced slits 52, which extend from the top wall 54 of the member down to a point above the base portion 46, thereby defining a series of radially displaceable fingers 56. A plunger block 58, also of cylindrical shape, is slidably mounted within cylindrical member 44; it has a central bore 60 in which is received a bolt 62 which has its lower end 63 fixedly engaged to the top part of the fixed support 48 and its upper end 64 resting against a restricted shoulder portion 65 of bore 60. Head 64 of bolt 62 limits the upward movement of plunger block 58. The lower portion of the plunger block includes also a bore 66 which snuggly fits over the upper part of support 48 to limit the downward movement of the plunger block 58. A spring 68 is mounted inside member 44 around support 48 and has its opposite ends bearing respectively against the underface 70 of the plunger block and the top wall 72 of base portion 46.

Bottle 20 sits on top wall 73 of plunger block 58. This top wall 73 extends outside member 44 and beyond the plane of top wall 54. As seen in FIG. 2, when the band portion 40 of the handle rests on top wall 54, the protruding marginal edge of the plunger block is hidden by the band 40.

In one preferred form of the invention, an annular wear ring 75 is mounted to the plunger block 58 and is the contacting point between the plunger block and the inner walls 79 of the fingers; the diameter of ring 75 should be slightly greater than that of the outside wall 77 of the block. Walls 79 of the fingers are sloped and this serves to provide a gradual opening of fingers 56 when ring 75 slides downward along the walls. Ring 75 is preferred since it may easily be replaced after excessive wear.

The bottle holder 26 has a central cavity 74 to fittingly receive the upper part of the bottle. A rubber shock absorbing ring 78 may be provided inside the holder to contact the bottle.

In operation, a plastic bail band is placed on top wall 54 around the marginal protruding end of plunger block 58. Then, a bottle 20 is placed on top wall 73 of the block. Bottle holder 26 is then actuated, manually or otherwise, to contact the upper part of bottle 20. Downward pressure is then exerted through the operation of the hydraulic cylinder 28 (or through a mechanical equivalent) causing downward movement of plunger block 58 inside member 44. As ring 75 slides along the inside walls 79 of fingers 52, the latter gradually and uniformly open. The contacting point of the wear ring on the walls must be accurately calculated so as to avoid any contact between the inner top edge of top wall 54 with the bottle. As seen in FIGS. 3 and 4, the radial displacement of the fingers is such that the bottle's lower edge never contacts member 44. In FIG. 3, the handle is shown to expand as it slides up the rounded lower edge of the bottle; this expansion is done by the bottle. In FIG. 4, the handle is further moved and pushed into recess 36 by the fingers which, however, still remain at a small distance from the bottle. The downward movement of plunger 58 stops when surface 67 in bore 66 contacts the top wall of fixed support 48. When pressure is removed, the plunger block returns upwards to its original position under the action of spring 68. The upward movement of plunger block 58 stops when shoulder 65 contacts head 64.

Satisfactory results have been obtained with a device made in accordance with the present invention wherein the plunger block is made of plastics, such as Nylon 101 (Trademark), and the cylindrical member 44 is made also of plastics, such as Nylon 901 (Trademark).

It will be evident to the man skilled in the art to mount a series of these devices on a rotating table for successively insertng plastic handles on serially fed and conveyed bottles and/or containers.

What is claimed is:

1. Apparatus for inserting a resilient band on a container adjacent one end thereof, comprising: an outer cylindrical member having a top wall for receiving thereon said band to be inserted, said member having a side wall provided with a series of circumferentially spaced slits extending from said top wall to a location therebeneath on said side wall to define a series of fingers pivotable about their lower portions; plunger means slidably mounted coaxially within said cylindrical member and in contacting engagement with said fingers, said plunger means having a top wall for receiving said one end of said container thereon; said plunger means being actuable to move downwardly within said member to thereby cause outward pivotal movement of said fingers whereby said band on said top wall of said cylindrical member is caused to slide on said container into a predetermined position thereon, said outward pivotal movement of said fingers being such that contact of said fingers with said container is prevented as sais band slides on said container into said predetermined position.

2. Apparatus for inserting a plastic band on a parenteral solution having a band-receiving recess, comprising: an outer cylindrical member having a top wall for receiving thereon said band, said member having a side wall to define a series of fingers pivotable about their lower portions; plunger means slidably mounted coaxially within said cylindrical member and in contacting engagement with said fingers, said plunger means having a top wall for receiving thereon the bottom end of said bottle; said plunger means being actuable to move downwardly within said to thereby cause outward pivotal movement of said fingers whereby said band on top wall of said member is caused to slide along the edge of said bottle bottom and thence upwardly along the sides of the bottle into said recess; said outward pivotal movement of said fingers being such that contact of fingers with said bottle is prevented as said band slides on said bottle into the recess thereof.

3. Apparatus as defined in claim 1 or 2 wherein said fingers are provided with tapering inner walls, the taper being predetermined so that said fingers avoid contact with a container on said plunger means.

4. Apparatus as defined in claim 1 or 2, wherein said plunger means include a replaceable wear ring mounted thereon; said ring contacting the inner wall of said fingers.

5. An apparatus as defined in claim 1, wherein said plunger means include a cylindrical block and spring means are located between said member and said block for returning said plunger means to its original position after band insertion.

6. An apparatus as defined in claim 4, further comprising stop means within said cylindrical member for limiting the returning movement of said plunger means in said member.

7. Apparatus as defined in claim 1 or 2 including actuator means for moving said plunger means within said cylindrical member comprising means engageable with the opposite end of said container and means associated therewith for effecting downward movement of said container and of said plunger means within said cylindrical member.

8. Apparatus as defined in claim 1 or 2 wherein a portion of said plunger means protrudes outside said member beyond the plane of said top wall of said member, said band received on said top wall of said member surrounding said protruding portion of said plunger means.

9. Apparatus as defined in claim 2 or 5, wherein said cylindrical member and said plunger means are made of a rigid plastic.

* * * * *